United States Patent [19]

Rainis et al.

[11] 4,388,181

[45] Jun. 14, 1983

[54] METHOD FOR THE PRODUCTION OF METALLURGICAL GRADE COAL AND LOW ASH COAL

[75] Inventors: Andrew Rainis, Walnut Creek; Clifford M. Detz, San Rafael, both of Calif.

[73] Assignee: Chevron Research Company, San Francisco, Calif.

[21] Appl. No.: 330,303

[22] Filed: Dec. 14, 1981

[51] Int. Cl.[3] ..... B03D 1/08; B03D 3/06

[52] U.S. Cl. ..... 209/12; 209/5; 209/166; 210/725

[58] Field of Search ..... 264/117; 209/5, 49, 209/12, 166, 167; 210/710, 724, 725, 727; 44/15 R, 24

[56] References Cited

U.S. PATENT DOCUMENTS

| | | | |
|---|---|---|---|
| 4,080,176 | 3/1978 | Verschuur | 44/1 R |
| 4,239,718 | 12/1980 | Dudt | 264/117 |
| 4,248,698 | 2/1981 | Keller | 209/5 |
| 4,253,944 | 3/1981 | Hefner | 209/166 |
| 4,270,927 | 6/1981 | Burk et al. | 209/5 X |
| 4,284,413 | 8/1981 | Capes et al. | 44/24 X |
| 4,323,365 | 4/1982 | Crosby et al. | 209/5 X |

OTHER PUBLICATIONS

Mehrotra et al., "Oil Agglomeration . . . Advantages," Mining Engineering, Aug. 1980, pp. 1230–1235.

*Primary Examiner*—Ralph J. Hill

*Attorney, Agent, or Firm*—D. A. Newell; S. R. LaPaglia; E. A. Schaal

[57] ABSTRACT

A method is disclosed for the production of metallurgical grade coal and low ash coal by the combination of froth flotation and selective agglomeration.

5 Claims, No Drawings

METHOD FOR THE PRODUCTION OF METALLURGICAL GRADE COAL AND LOW ASH COAL

BACKGROUND OF THE INVENTION

The present invention relates to a method of producing two products: a metallurgical grade coal and a low ash coal suitable as a steam coal.

There are a variety of known techniques for separating two solids, based on differences in characteristics between the two solids. For instance, materials can be separated based on their size, their density, their ability to hold an electrical charge, or their magnetic characteristics. These methods are useful for most solid separation applications, but there are some solids that cannot be economically separated by these methods because the two solids are too similar in these characteristics.

A solution to this problem is to use a different characteristic, such as affinity for water, to separate the two solids. In one known method, ash is separated from coal by forming a coal slurry, mixing oil into the slurry to produce agglomerates, and recovering the agglomerates as product. Most of the ash remains in the aqueous phase of the slurry.

A major disadvantage of this method is that the oil used to agglomerate the coal becomes part of the product. This means that one is selling oil at the price of coal. It is possible to try to recover the oil from the agglomerates, but this would require extremely high temperatures (in excess of 260° C.) and, even at these high temperatures, the oil recovery would not be complete.

Pyritic sulfur is not normally removed by this process. The fuel oil has components in it which activate the surfaces of both the coal and the pyritic sulfur to make both more hydrophobic, thus the pyritic sulfur is agglomerated with the coal.

Another method of separating two solids is by froth flotation. Froth flotation is a process for separating finely ground valuable minerals from their associated gangue. The process is based on the affinity of properly prepared surfaces for air bubbles. A froth is formed by introducing air into a pulp of finely divided ore in water containing a frothing or foaming agent. Surface modifying reagents (collectors) may be also added to increase the affinity of the mineral surface for air bubbles. Minerals with a specific affinity for air bubbles rise to the surface in the froth and are thus separated from those wetted by water. As a first step, the ore must first be ground to liberate the intergrown valuable mineral constituent from its worthless gangue matrix. The size reduction, usually to about 208 microns (65 mesh), reduces the minerals to such a particle size that they may be easily levitated by the bubbles.

Froth flotation can be used to produce a metallurgical grade coal. In froth flotation of bituminous coal, the fraction most easily and rapidly floated is rich in vitrinite, a constituent of coal, with a low ash content and good coking properties. Vitrinite is the material needed to make a good metallurgical grade coal. The remaining fraction has a high content of ash and pyritic sulfur.

SUMMARY OF THE INVENTION

The present invention overcomes the deficiencies of the prior art by the combination of froth flotation and selective agglomeration of the coal. In the present invention, an aqueous slurry is formed of coal containing vitrinite, ash and pyritic sulfur; a froth flotation reagent is added to the slurry; the slurry is subjected to froth flotation to produce an overflow and an underflow; the overflow, which is rich in vitrinite and has a low content of ash and pyritic sulfur, is filtered and dried to produce a metallurgical grade coal; a nonpolar, water insoluble, bridging hydrocarbon is used to selectively form agglomerates of coal from the underflow, which has a low content of vitrinite and is rich in ash and pyritic sulfur; the agglomerates which are low in ash and pyritic sulfur are separated from the underflow containing the ash and the pyritic sulfur; and the bridging hydrocarbon is recovered and recycled. An essential element of this invention is the bridging hydrocarbon used. It is essential that the bridging hydrocarbon have a low boiling point (70° C. or less), such as butane, pentane, hexane, and mixtures thereof.

In one embodiment of the present invention, a coal slurry is subjected to froth flotation and the underflow is further ground as a slurry so that the particle size distribution of the underflow has at least 90% of the particles less than 75 microns in size, then the agglomerates are formed by subjecting the underflow and bridging hydrocarbon to high-shear agglomeration and low-shear agglomeration.

Preferably, the initial slurry of coal, ash and pyritic sulfur should contain 10% to 20% by weight solids and the separation step should be carried out using a screening means or a centrifuge.

DESCRIPTION OF THE PREFERRED EMBODIMENTS

In its broadest application, the present invention involves producing a metallurgical grade coal and a low ash steam coal by forming an aqueous slurry of coal containing vitrinite, ash and pyritic sulfur; adding a froth flotation reagent to the slurry; subjecting the slurry to froth flotation to produce an underflow and an overflow; filtering and drying the overflow to produce a metallurgical grade coal; then selectively agglomerating the underflow in such a way as to agglomerate the coal, but not the ash and pyritic sulfur. This selective agglomeration is carried out by the use of a nonpolar, water insoluble, bridging hydrocarbon. After the selective agglomeration takes place, the agglomerates can be separated by a screening device or a centrifuge, then the bridging hydrocarbon can be recovered and recycled.

The first step in this invention is forming an aqueous slurry of coal containing vitrinite, ash and pyritic sulfur.

A froth flotation reagent is added to the slurry and the slurry is subjected to froth flotation under conditions which produce a vitrinite rich overflow and an underflow. The vitrinite rich fraction has a low content of ash and pyritic sulfur. The underflow has a low content of vitrinite and is rich in ash and pyritic sulfur.

The overflow is filtered and dried to produce a metallurgical grade coal.

Preferably, the underflow has a solids content of from 30% to 40% by weight prior to grinding. When there is no grinding step, the underflow should have a solids content of from 10% to 20% by weight.

As a preferred additional step, the underflow can be ground in the slurry so that the particle size distribution of the underflow has at least 90% of the particles less than 75 microns in size, more preferably less than 10 microns. Such a grinding step would be used whenever the ash and pyritic sulfur are fine grained. The grinding step helps to liberate the ash and pyritic sulfur from the coal. The grinding step occurs prior to the addition of the bridging hydrocarbon, otherwise agglomerates would form during grinding and reduce the grinding efficiency.

An agglomerant is added to the underflow in order to selectively agglomerate the coal. This agglomerant is a low boiling, nonpolar, water insoluble hydrocarbon having a boiling point of 70° C. or less. This agglomerant may be butane, pentane, hexane, or a mixture thereof. The underflow should contain from 10% to 40% of agglomerant on an agglomerant and dry coal weight basis.

The agglomerant should be low boiling so that it can be readily recovered at low temperatures and can be recycled to reduce the agglomerant requirement. High boiling hydorcarbons, such as fuel oil, are hard to recover, even at temperatures of 260° C. and higher. If fuel oil is used as an agglomerant, extremely high temperatures are required to recover the agglomerant and these high temperatures represent a severe penalty in energy requirements. Even at these high temperatures, fuel oil recovery is incomplete. For these reasons, low boiling agglomerants are preferred over fuel oil. As a general rule, increases in agglomerant boiling point cause recovery of the agglomerant to be more difficult since the agglomerant is more strongly adsorbed on the coal surface.

The agglomerant should be nonpolar for a better distribution of the organic between the aqueous phase and the solid. As polarity increases, more agglomerant is lost in the aqueous phase.

The agglomerant should be a hydrocarbon, instead of other nonpolar insoluble agglomerants such as freon, because these hydrocarbons are cheaper than other nonpolar agglomerants and because halogens in the product could cause problems downstream, such as corrosion.

One advantage of using as agglomerant either butane, pentane, hexane, or mixtures thereof, is that these agglomerants give a lower ash product than when fuel oils are used.

Another advantage of these low-boiling agglomerants is that they have lower densities than other agglomerants. In agglomeration, there is an optimum volume of agglomerant that is needed to give good, easily separable agglomerates. The energy required to remove the agglomerant depends upon the weight present. Thus, if two liquids of equal heat of vaporization are used, the energy required to remove equal volumes will be less for the liquid of lower density.

The agglomerant needs to have a low viscosity to achieve low ash in the final product. High viscosity increases the time needed to form agglomerates and, with fuel oils, increases the ash and sulfur content of the product.

If an agglomerant-free product is desired, then the agglomerant must be volatile, it must be recoverable at a reasonable temperature (30° C. to 70° C.) and it should not be strongly adsorbed into the coal. The agglomerants of the present invention satisfy these criteria.

Preferably, the agglomerant is added to the underflow in a premixer to give a homogeneous feed. In the premixer, a surface conditioner, such as fuel oil, can be added to make the coal more hydrophobic (5% or less by weight on a coal and oil basis).

If the underflow has been ground, the underflow is diluted to a solids content of from 10% to 20% by weight prior to agglomeration.

The coal is selectively agglomerated and the ash and pyritic sulfur remain dispersed in the slurry. The coal can be subjected to either low-shear agglomeration alone or in combination with high-shear agglomeration. The combination of low-shear agglomeration and high-shear agglomeration is preferred.

Whenever high-shear agglomeration is used, it must be followed by a period of relatively low turbulence so that the agglomerates formed in the high-shear zone can form a more compact, more easily separable product. The agglomerates coming out of the high-shear zone are quite small and would cause separation problems if the subsequent period of relatively low turbulence is missing.

After the coal agglomerates are formed, they can be separated from the slurry by any known separation technique. Preferably, the agglomerates are removed from the underflow by using either a screen or a centrifuge. A sieve bend is a particularly advantageous screening means because of its low cost.

After the agglomerates are separated from the underflow, they are heated or flashed to remove the agglomerant. To maximize recovery of the agglomerant, the product leaving the heated zone should be discharged at a temperature in excess of the boiling point of the agglomerant. An inert atmoshpere or vacuum should be used in the heating step to reduce the chance of either the coal or the agglomerant from catching fire.

An advantage of the present invention is that the low boiling agglomerants of the present invention do not require high temperatures in order to be removed, thus saving energy.

The agglomerant is then recovered from the inert atmosphere and is recycled. In one agglomerant recovery process, the agglomerant and the inert gas are passed through a bag filter for dust removal, then the agglomerant and inert gas are passed through a compressor and a agglomerant recovery condenser, which recovers the agglomerant from the gas. The gas leaving the condenser is passed through a carbon adsorption system which further removes agglomerant. The agglomerant is then recycled as a source of make-up agglomerant for the premixer and the inert gas is recycled to the heating zone.

While the present invention has been described with reference to specific embodiments, this application is intended to cover those changes and substitutions which may be made by those skilled in the art without departing from the spirit and scope of the appended claims.

1. A method of producing a metallurgical grade coal and a low ash coal comprising:

(a) forming an aqueous slurry of coal containing vitrinite, ash and pyritic sulfur;

(b) adding to said slurry a froth flotation reagent;

(c) subjecting said slurry to froth flotation to produce an overflow and an underflow, wherein said overflow is rich in vitrinite and has a low content of ash and pyritic sulfur; and wherein said underflow has a low content of vitrinite and is rich in ash and pyritic sulfur;

(d) filtering and drying the froth flotation overflow to produce a metallurgical grade coal;

(e) using a nonpolar, water insoluble, bridging hydrocarbon having a boiling point of less than 70° C. to selectively form agglomerates of coal from said underflow;

(f) separating the agglomerates of coal from the underflow containing the ash and pyritic sulfur;

(g) recovering the bridging hydrocarbon; and (h) recycling the bridging hydrocarbon to step (e).

2. A method of producing a metallurgical grade coal and a low ash coal according to claim 1 wherein the bridging hydrocarbon is selected from the group consisting of butane, pentane, hexane, and mixtures thereof.

3. A method of producing a metallurgical grade coal and a low ash coal according to claim 1 wherein the underflow in step (a) has from 10 to 20% by weight solids content.

4. A method of producing a metallurgical grade coal and a low ash coal comprising:

(a) forming an aqueous slurry of coal containing vitrinite, ash and pyritic sulfur;

(b) adding to said slurry a froth flotation reagent;

(c) subjecting said slurry to froth flotation to produce an overflow and an underflow, wherein said overflow is rich in vitrinite and has a low content of ash and pyritic sulfur; and wherein said underflow has a low content of vitrinite and is rich in ash and pyritic sulfur;

(d) filtering and drying the froth flotation overflow to produce a metallurgical grade coal;

(e) using a nonpolar, water insoluble, bridging hydrocarbon having a boiling point of less than 70° C. to selectively form agglomerates of coal from said underflow by subjecting the underflow and bridging hydrocarbon to high-shear agglomeration and low-shear agglomeration;

(f) separating the agglomerates of coal from the underflow containing the ash and pyritic sulfur;

(g) heating the agglomerates to remove the bridging hydrocarbon;

(h) recovering the bridging hydrocarbon; and (i) recycling the bridging hydrocarbon to step (e).

5. A method of producing a metallurgical grade coal and a low ash coal according to claim 4 wherein the separation step (f) is carried out using either a screening means or a centrifuge.

* * * * *